US007950907B2

(12) United States Patent
Nagata et al.

(10) Patent No.: US 7,950,907 B2
(45) Date of Patent: May 31, 2011

(54) FLUID PUMP HAVING HOUSING

(75) Inventors: Kiyoshi Nagata, Nagoya (JP); Shinji Sumiya, Hekinan (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 1236 days.

(21) Appl. No.: 11/515,778

(22) Filed: Sep. 6, 2006

(65) Prior Publication Data

US 2007/0065314 A1 Mar. 22, 2007

(30) Foreign Application Priority Data

Sep. 6, 2005 (JP) ..... 2005-257416
Jun. 21, 2006 (JP) ..... 2006-171173

(51) Int. Cl.
*F04B 17/00* (2006.01)
*F04B 39/00* (2006.01)

(52) U.S. Cl. ..... 417/423.14; 417/366; 417/423.1; 417/423.7

(58) Field of Classification Search ..... 417/366, 417/423.1, 423.7, 423.14
See application file for complete search history.

(56) References Cited

U.S. PATENT DOCUMENTS

| | | | | |
|---|---|---|---|---|
| 5,015,159 | A * | 5/1991 | Mine et al. | 417/366 |
| 5,120,201 | A | 6/1992 | Tuckey et al. | |
| 5,356,272 | A * | 10/1994 | Nagata et al. | 417/366 |
| 5,472,321 | A | 12/1995 | Radermacher | |
| 6,765,319 | B1 | 7/2004 | Thompson | |
| 6,875,003 | B2 | 4/2005 | Aono | |
| 2001/0048844 | A1 | 12/2001 | Bratthall et al. | |
| 2002/0047329 | A1 | 4/2002 | Sashino et al. | |
| 2004/0208763 | A1 | 10/2004 | Yu et al. | |
| 2005/0074343 | A1 | 4/2005 | Naito | |
| 2005/0118044 | A1 * | 6/2005 | Inoue et al. | 417/423.7 |
| 2005/0220641 | A1 * | 10/2005 | Nagata et al. | 417/423.3 |
| 2007/0052310 | A1 | 3/2007 | Sakai et al. | |
| 2007/0065315 | A1 | 3/2007 | Nagata et al. | |
| 2007/0086905 | A1 | 4/2007 | Nagata et al. | |

FOREIGN PATENT DOCUMENTS

| | | |
|---|---|---|
| DE | 34 23 316 C2 | 10/1993 |
| DE | 42 43 225 A1 | 6/1994 |
| DE | 197 04 403 | 8/1998 |
| JP | 63-176686 | 7/1988 |
| JP | 5-340345 | 12/1993 |
| JP | 2001-268874 | 9/2001 |
| JP | 2004-176704 | 6/2004 |
| JP | 2005-110477 | 4/2005 |

OTHER PUBLICATIONS

Chinese Office Action dated Apr. 4, 2008 issued in corresponding Chinese Application No. 200610129049.2 with English translation.
Examination Report Apr. 3, 2009 in CN 2006101290492 with English Translation.
Indian Office Action dated May 2008, issued in corresponding Indian Application No. 1610/CHE/2006 with English translation.
German Office Action mailed Jun. 18, 2007 in German Application No. 10 2006 000 448.5-15 with English translation.

(Continued)

*Primary Examiner* — Devon C Kramer
*Assistant Examiner* — Leonard J Weinstein
(74) *Attorney, Agent, or Firm* — Nixon & Vanderhye PC

(57) ABSTRACT

A fluid fuel pump and its electrically driven brushless motor are located at opposite ends of a common housing.

16 Claims, 6 Drawing Sheets

OTHER PUBLICATIONS

US Serial No. Not yet assigned; Filed Sep. 6, 2006; Inv.: Nagata et al; JP counterpart JP-2005-257416, JP-2005-302968, JP-2005-315974, JP-2005-347593, JP-2006-171173.

US Serial No. Not yet assigned; Filed Sep. 6, 2006; Inv.: Nagata et al; JP counterpart JP-2005-257416, JP-2005-302968, JP-2005-315974, JP-2005-347593, JP-2005-363423, JP-2006-154435, JP-2006-171173.

Office Action dated Jan. 4, 2008 in CN Application No. 200610129052.4 with English translation.

Office Action dated Jul. 11, 2008 in CN Application No. 200610129052.4 with English translation.

German Office Action dated Jun. 15, 2007 in German Application No. 10 2006 000 447.7-15 with English translation.

German Office Action dated Jun. 15, 2007 in German Application No. 10 2006 000 446.9-15 with English translation.

Office Action dated Oct. 24, 2008 in CN Patent Application No. 200610129049.2 with English translation.

German Office Action dated Apr. 22, 2010, issued in corresponding German Application No. 10 2006 000 448.5-15, with English translation.

Japanese Office Action dated Feb. 24, 2011 issued in corresponding Japanese Application No. 2006-171173, with English translation.

* cited by examiner

FLUID PUMP HAVING HOUSING

CROSS REFERENCE TO RELATED APPLICATIONS

This application is based on and incorporates herein by reference Japanese Patent Applications No. 2005-257416 filed on Sep. 6, 2005, and No. 2006-171173 filed on Jun. 21, 2006.

FIELD OF THE INVENTION

The present invention relates to a fluid pump having a housing.

BACKGROUND OF THE INVENTION

For example, according to US 2005/0074343 A1 (JP-A-2005-110478), a fuel pump includes a brushless motor. In general, a motor (brush-type motor) having contact brushes causes losses such as slide resistance between a commutator and a brush, electric resistance between the commutator and the brush, and fluid resistance caused by grooves, via which the commutator is divided into segments. By contrast, a brushless motor may not cause the above losses arising in the brush-type motor. Therefore, a brushless motor is higher than a brush-type motor in motor efficiency, so that a fuel pump having a brushless motor is enhanced in pump efficiency. Here, the pump efficiency is a ratio of an amount of work produced by the fuel pump relative to electricity supplied to the fuel pump. The amount of work produced by the fuel pump can be calculated by multiplying fuel discharge pressure by a fuel discharge amount.

When the amount of work is constant, as the efficiency of the fuel pump increases, a motor portion can be downsized, so that the fuel pump can be downsized. A fuel pump including a brushless motor may be applied to a small vehicle such as a motor cycle.

A fuel pump including a brush-type motor has a stator core that is located radially outside a rotator. The outer circumferential periphery of the stator core is surrounded by a housing for restricting fuel from leaking. The housing is not necessary to form a magnetic circuit in a brushless motor. According to US 2005/0074343 A1, the thickness of the housing is larger in a portion surrounding the outer circumferential periphery of the stator core. Accordingly, in this structure, the outer diameter of the housing surrounding the stator core is relatively large. Consequently, it is difficult to reduce the outer diameter of the fuel pump.

SUMMARY

In view of the foregoing and other problems, it is an object of the present exemplary embodiment to produce a fluid pump that includes a downsized housing.

According to one aspect of the present exemplary embodiment, a fluid pump includes a stator core having an inner circumferential periphery. The fluid pump further includes a plurality of coils that are wound around the stator core. The plurality of coils circumferentially generate magnetic poles in the inner circumferential periphery of the stator core when being supplied with electricity. The magnetic poles are switched by controlling electricity supplied to the plurality of coils. The fluid pump further includes a rotor that is rotatable within the inner circumferential periphery of the stator core. The rotor has an outer circumferential periphery opposed to the inner circumferential periphery of the stator core. The outer circumferential periphery defines magnetic poles different from each other with respect to a rotational direction of the rotor. The fluid pump further includes a pump portion that has a rotor member. The rotor of the motor is adapted to rotate the rotor member of the pump for pumping fuel.

According to one aspect of the present exemplary embodiment, the fluid pump further includes a housing that has a pump housing portion and a motor housing portion. The pump housing portion surrounds the outer circumferential periphery of the pump portion. The motor housing portion defines an accommodating portion that surrounds an outer circumferential periphery of the stator core. The motor housing portion is dented radially inwardly with respect to the pump housing portion. The motor housing portion may have an outer diameter that is less than an outer diameter of the pump housing portion.

Alternatively, according to another aspect of the present exemplary embodiment, the fluid pump further includes a housing that has an inner circumferential periphery defining a recession, which accommodates the stator core.

Alternatively, according to another aspect of the present exemplary embodiment, the fluid pump further includes a housing that includes a pump housing portion, an intermediate housing portion, and a motor housing portion. The pump housing portion circumferentially surrounds the outer circumferential periphery of the pump portion. The motor housing portion circumferentially surrounds the outer circumferential periphery of the stator core. The intermediate housing portion is interposed axially between the pump housing portion and the motor housing portion. The intermediate housing portion has an inner diameter that is less than an inner diameter of the pump housing portion. The inner diameter of the intermediate housing portion is less than an inner diameter of the motor housing portion.

BRIEF DESCRIPTION OF THE DRAWINGS

The above and other objects, features and advantages of the present exemplary embodiment will become more apparent from the following detailed description made with reference to the accompanying drawings. In the drawings.

DETAILED DESCRIPTION OF PREFERRED EMBODIMENTS

First Embodiment

Figure 1:
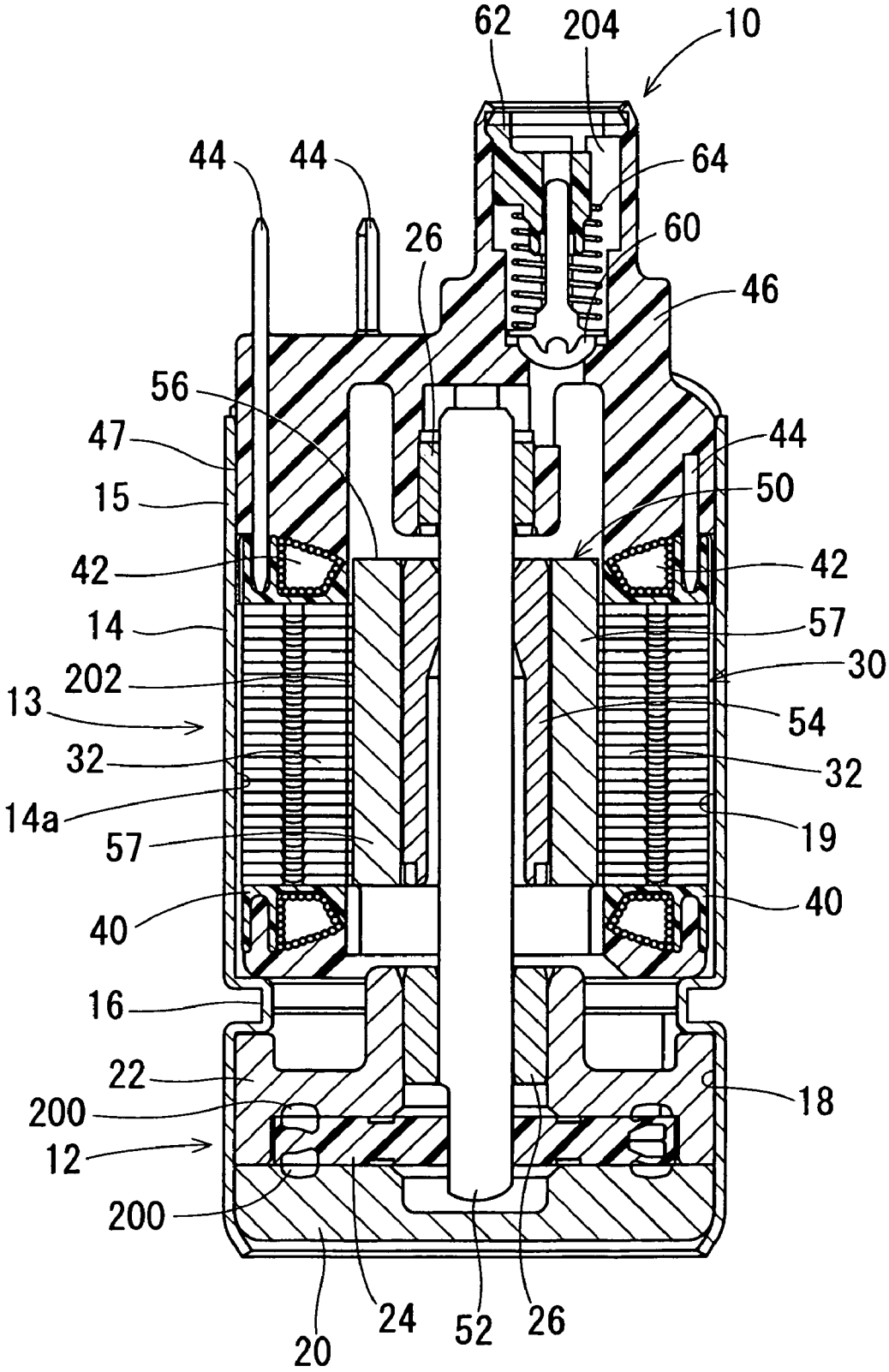
FIG. 1 is a longitudinal partially sectional view showing a fuel pump according to a first embodiment.

As shown in FIG. 1, a fuel pump 10 may be an in-tank turbine pump that is provided in a fuel tank of a motorcycle with an engine size of 150 cc, for example.

The fuel pump 10 includes a pump portion 12 and a motor portion 13. The motor portion 13 rotates the pump portion 12. A housing 14 is shaped by press-forming a metallic thin plate to be in a cylindrical shape. The thickness of the metallic thin plate may be around 0.5 mm. The housing 14 at least partially accommodates the pump portion 12 and the motor portion 13. The housing 14 formed of the thin plate has an inwardly directed protrusion 16. The protrusion 16 is formed by radially inwardly denting the circumferential periphery of the housing 14 between the pump portion 12 and the motor portion 13. The housing 14 has an inner circumferential periphery 14*a* that defines axially extending recesses 18, 19 on both sides of protrusion 16. The protrusion 16 is axially interposed between the recesses 18, 19.

The pump portion 12 serves as a turbine pump. The pump portion 12 includes pump cases 20, 22, and an impeller 24, for example. The pump case 22 is press-inserted into the recession 18 of the housing 14, and axially abutted against the protrusion 16 of the housing 14. Thus, the pump case 22 is axially aligned. The pump case 20 is fixed by crimping one end of the housing 14. When the pump case 20 is fixed by crimping the one end of the housing 14, the housing 14 is applied with axial force by a crimping jig attached to the outer circumferential periphery of the protrusion 16 of the housing 14.

The pump cases 20, 22 rotatably accommodate the impeller 24 as a rotor member. The pump cases 20, 22 and the impeller 24 define pump passages 200 thereamong. The pump passages 200 are in substantially C-shapes. Fuel is drawn through an unillustrated inlet port provided to the pump case 20, and is pressurized through the pump passages 200 by rotation of the impeller 24, thereby being press-fed toward the motor portion 13. The fuel press-fed toward the motor portion 13 is supplied toward an engine through an outlet port 204 after passing through a fuel passage 202. The fuel passage 202 is defined between the stator core 30 and the rotator 50.

The motor portion 13 is a brushless motor that includes the stator core 30, bobbins 40, coils 42, and the rotator 50. The stator core 30, the bobbins 40, and the coils 42 are accommodated in the recession 19 of the housing 14. The stator core 30 is formed by crimping axially stacked magnetic steel plates to each other. The stator core 30 is provided with six teeth protruding toward the center of the motor portion 13. The six teeth are circumferentially arranged at substantially regular intervals. Each of the coils 42 is wound around each of the bobbins 40 of each of the teeth 32.

Each of the coils 42 electrically connects with each of terminals 44. Supplying electricity to each of the coils 42 is controlled in accordance with a rotational position of the rotator 50. An end cover 46 is integrally molded of electrically insulative resin when the stator core 30 and the coils 42 are molded of the electrically insulative resin. The end cover 46 has an outer circumferential periphery 47 that is press-inserted into an end 15 of the housing 14. In FIG. 1, the winding of each of the coils 42 is not illustrated.

The rotator 50 includes a shaft 52, a rotational core 54, and a permanent magnet 56. The rotator 50 is rotatable within the inner circumferential periphery of the stator core 30. The shaft 52 is rotatably supported by bearings 26 at both ends. The permanent magnet 56 is a resin magnet that is produced by mixing magnetic powder with thermoplastic resin such as polyphenylene sulfide (PPS). The permanent magnet 56 is in a substantially cylindrical shape. The permanent magnet 56 is located around the outer circumferential periphery of the rotational core 54. The permanent magnet 56 has eight magnetic poles 57 arranged with respect to the rotative direction. The eight magnetic poles 57 are magnetized to define magnetic poles toward the outer circumferential periphery of the permanent magnet 56. The outer circumferential periphery of the permanent magnet 56 is opposed to the inner circumferential periphery of the stator core 30. The magnetic poles are different from each other with respect to the rotative direction.

The end cover 46 has the outlet port 204 that accommodates a valve member 60, a stopper 62, and a spring 64. The valve member 60 is lifted against bias force of the spring 64 when pressure of fuel pressurized in the pump portion 12 becomes equal to or greater than a predetermined pressure, so that fuel is discharged toward the engine through the outlet port 204.

In the first embodiment, the protrusion 16 is formed by circumferentially inwardly denting the housing 14, which is constructed of the thin plate substantially uniform in thickness, for example. The inner circumferential periphery 14*a* of the housing 14 defines the protrusion 16 and the recessions 18, 19. Components of the pump portion 12 and the motor portion 13 are accommodated in the recessions 18, 19 without partially increasing the thickness of the housing 14. Thus, the outer diameters of the pump portion 12 and the motor portion 13 are reduced.

In the first embodiment, the housing can be readily shaped such that the portion of the housing between the stator core and the pump portion is radially and inwardly dented, by such as press forming or die forming a thin plate in dependence on a material of the housing. Therefore, the recession can be readily formed in the inner circumferential periphery of the housing for accommodating the stator core.

Second Embodiment

Figure 2:
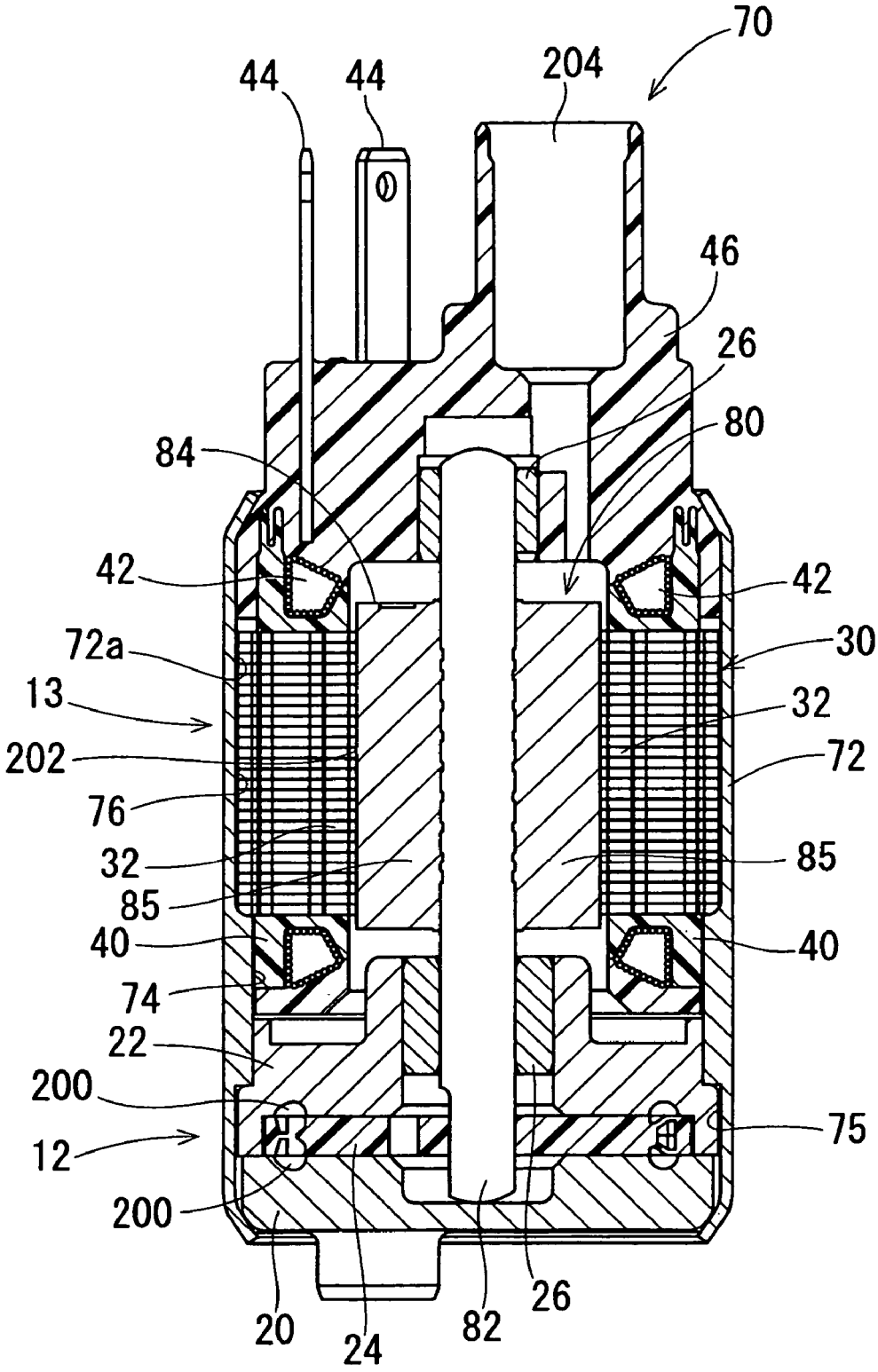
FIG. 2 is a longitudinal partially sectional view showing a fuel pump according to a second embodiment.

As shown in FIG. 2, in the second embodiment, a fuel pump 70 includes a metallic housing 72 that has a thick portion 74. The thick portion 74 radially protrudes inwardly between the pump portion 12 and the motor portion 13 in the metallic housing 72. The housing 72 has an inner circumferential periphery 72*a* that is thinner than the thick portion 74. The inner circumferential periphery 72*a* defines recessions 75, 76 that are located on axially both sides of the thick portion 74 serving as a protrusion. The recessions 75, 76 respectively accommodate components of the pump portion 12 and the motor portion 13. The inner circumferential periphery 72*a* of the housing 72 defines the thick portion 74 and the recessions 75, 76. The inner circumferential periphery 72*a* is accurately shaped by machining work after forging the housing 72, for example. Therefore, the center of the stator core 30, which is accommodated in the recession 76, and the center of a rotator 80, which is accommodated in the stator core 30, can be accurately aligned. Furthermore, the stator core 30 can be axially accurately aligned.

The pump case 20 and the end cover 46 are fixed by crimping both axial ends of the housing 72. The stator core 30 and the pump case 22 are abutted against the axial ends of the thick portion 74, so that the stator core 30 and the pump case 22 can be axially aligned.

The rotator 80 includes a shaft 82 and a permanent magnet 84. The permanent magnet 84 is directly fitted to the outer circumferential periphery of the shaft 82. The outer circumferential periphery of the shaft 82 is knurled. The permanent magnet 84 has eight magnetic poles 85 arranged with respect to the rotative direction. The eight magnetic poles 85 are magnetized to define magnetic poles toward the outer circumferential periphery of the rotator 80. The outer circumferential periphery of the rotator 80 is opposed to the inner circumferential periphery of the stator core 30. The magnetic poles are different from each other with respect to the rotative direction of the rotator 80.

In the second embodiment, the thick portion 74 inwardly protrudes circumferentially between the pump portion 12 and the motor portion 13, so that the inner circumferential periphery 72*a* of the housing 72 defines the recessions 75, 76 respectively accommodating the components of the pump portion 12 and the motor portion 13. The housing 72 is thin around the recessions 75, 76. Thus, the outer diameter of the fuel pump 70 is reduced.

In the second embodiment, the thick portion 74 defines the recessions 75, 76, so that the outer circumferential periphery of the housing 72 does not define a recession. Therefore, the outer circumferential periphery of the housing 72 can be readily plated uniformly for protecting the housing 72 from corrosion.

Third Embodiment

Figure 3:
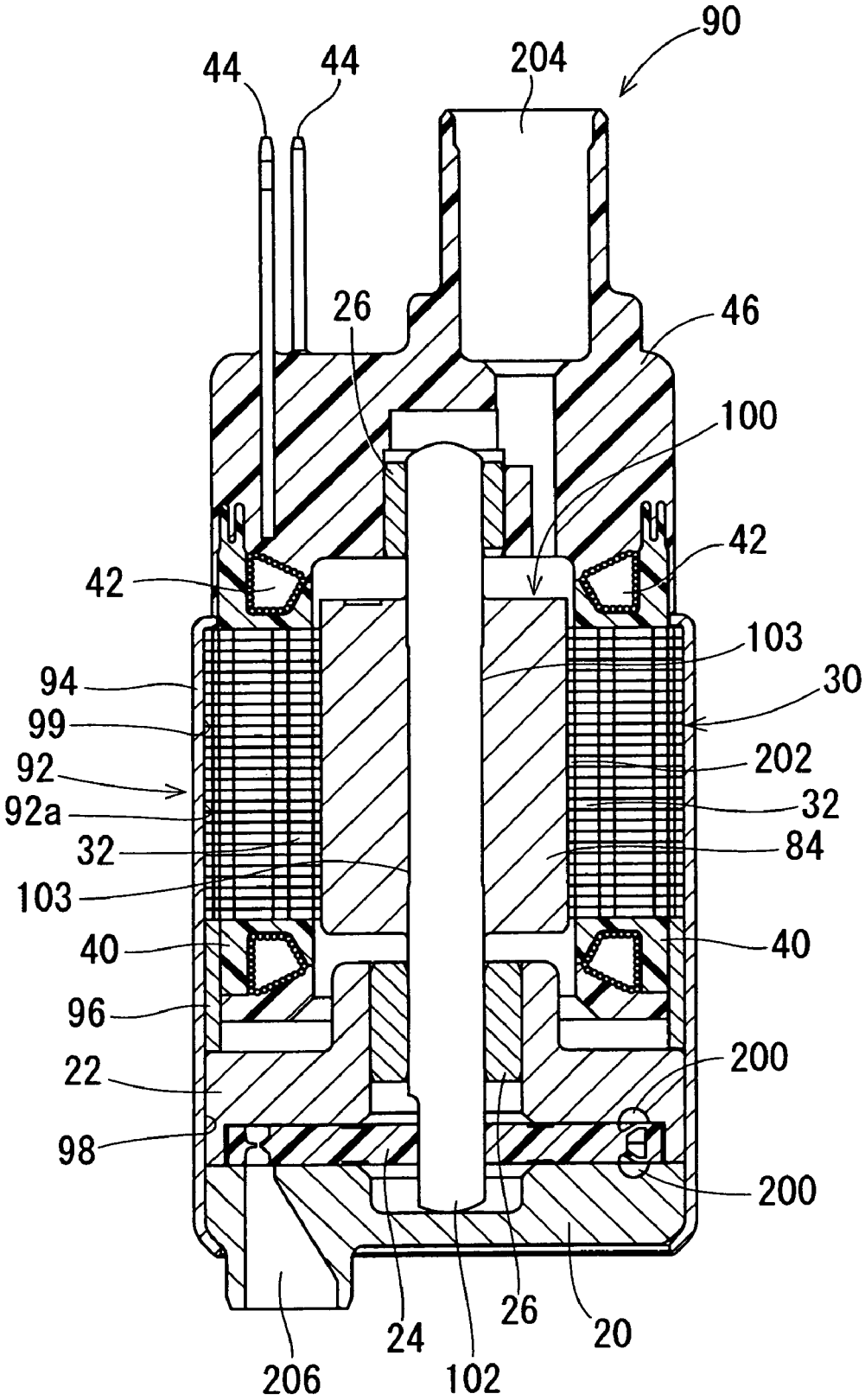
FIG. 3 is a longitudinal partially sectional view showing a fuel pump according to a third embodiment.

As shown in FIG. 3, in the third embodiment, a fuel pump 90 includes an outer circumferential housing 94 and an inner circumferential housing 96. The outer circumferential housing 94 and the inner circumferential housing 96 are shaped by press-forming metallic thin plates to be in substantially cylindrical shapes, for example. The inner circumferential housing 96 serving as a protrusion is press-inserted into the inner circumferential periphery of the outer circumferential housing 94, for example. The inner circumferential housing 96 is located between the pump portion 12 and the motor portion 13. The inner circumferential periphery 92*a* of the housing 92 defines recessions 98, 99 on axially both sides of the inner circumferential housing 96. The recessions 98, 99 respectively accommodate components of the pump portion 12 and the motor portion 13. The pump case 20 and the stator core 30 are fixed by crimping axially both ends of the outer circumferential housing 94. The pump case 22 and the stator core 30 are abutted against the axial ends of the inner circumferential housing 96, so that the pump case 22 and the stator core 30 can be axially aligned.

The rotator 100 is constructed of a shaft 102 and the permanent magnet 84. The permanent magnet 84 is fitted directly to the outer circumferential periphery of the shaft 102. The outer circumferential periphery of the shaft 102 has a chamfer 103.

In the third embodiment, the inner circumferential housing 96 is press-inserted into the inner circumferential periphery of the outer circumferential housing 94, for example. The inner circumferential housing 96 is located between the pump portion 12 and the motor portion 13, so that the recessions 98, 99 are defined. The recessions 98, 99 respectively accommodate components of the pump portion 12 and the motor portion 13. The housing 94 is thin around the recessions 98, 99. Thus, the outer diameter of the fuel pump 90 can be reduced.

In the third embodiment, the recession 99 can be readily formed for accommodating the stator core 30 in a simple structure, in which the inner circumferential housing 96 is press-inserted into the inner circumferential periphery of the outer circumferential housing 94, without increasing the thickness of the outer circumferential housing 94. The inner circumferential housing 96 may be welded and fixed to the inner circumferential periphery of the outer circumferential housing 94.

In the third embodiment, the inner circumferential housing 96 is press-inserted into the inner circumferential periphery of the cylindrical outer circumferential housing 94, so that the recessions 98, 99 are defined. The outer circumferential periphery of the outer circumferential housing 94 need not define a recession. Therefore, the outer circumferential periphery of the outer circumferential housing 94 can be readily plated uniformly for protecting the outer circumferential housing 94 from corrosion.

Fourth Embodiment

Figure 4:
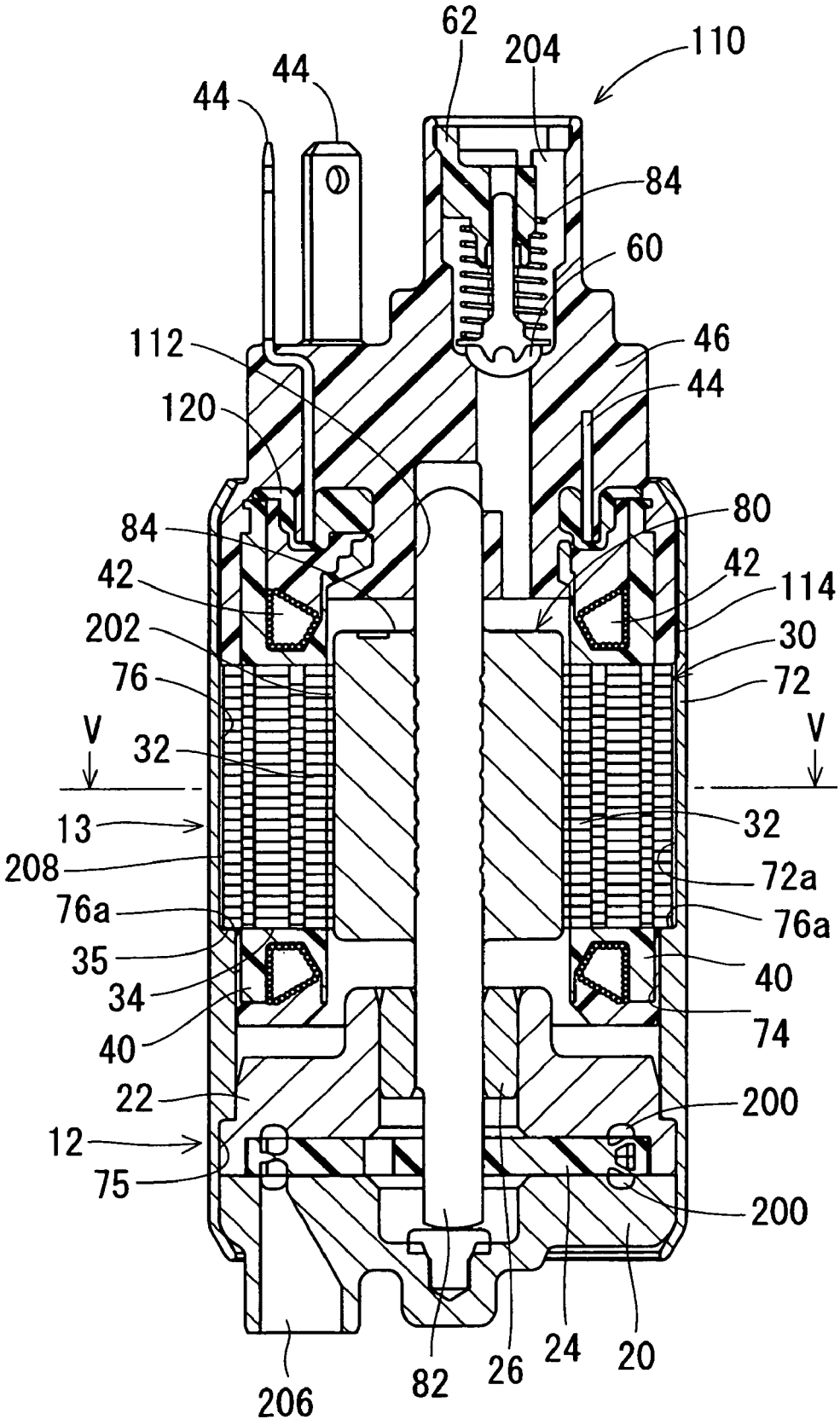
FIG. 4 is a longitudinal partially sectional view showing a fuel pump according to a fourth embodiment.

As shown in FIG. 4, the end cover 46 has a bearing hole 112 that directly supports one axial end of the shaft 82 in a fuel pump 110. The bearing hole 112 partially communicates with a fuel passage through which fuel is introduced from the motor portion 13 toward the outlet port 204. The end cover 46 has an outer circumferential periphery 114 that makes contact with the inner circumferential periphery 72*a* of the housing 72. The axial end of the housing 72 is crimped onto the end cover 46, so that the inner circumferential periphery 72*a* of the housing 72 and the outer circumferential periphery 114 of the end cover 46 define a fuel seal therebetween. Fuel may leak from the side of the inner circumferential periphery of the stator core 30 to the side of the outer circumferential periphery of the stator core 30. The fuel seal restricts the fuel from further leaking to the outside of the fuel pump 110. Thus, pressure of fuel increased in the fuel pump can be maintained.

The stator core 30 has an axial end 34 on the side of the pump portion 12. The axial end 34 has an outer circumferential end 35 on the side of the outer circumferential periphery of the bobbin 40. The circumferential periphery of the outer circumferential end 35 is at least partially or entirely not exposed to an electrically insulative resin, which is charged around the stator core 30 and the coils 42, and is formed to be the end cover 46. The outer circumferential end 35 is abutted against one axial end 76*a* of the recession 76 by crimping the housing 72 onto the end cover 46. Thus, the stator core 30 can be readily aligned axially with respect to the housing 72.

The outer circumferential periphery of the stator core 30 and the inner circumferential periphery 72*a* of the housing 72 define a fuel seal therebetween. The outer circumferential periphery 114 of the end cover 46 and the inner circumferential periphery 72*a* of the housing 72 define a fuel seal therebetween. The fuel seals and the portion of the outer circumferential end 35 of the stator core 30, which is abutted against the one axial end 76*a* of the recession 76, define a space 208 thereamong on the side of the outer circumferential periphery of the stator core 30.

Figure 5:
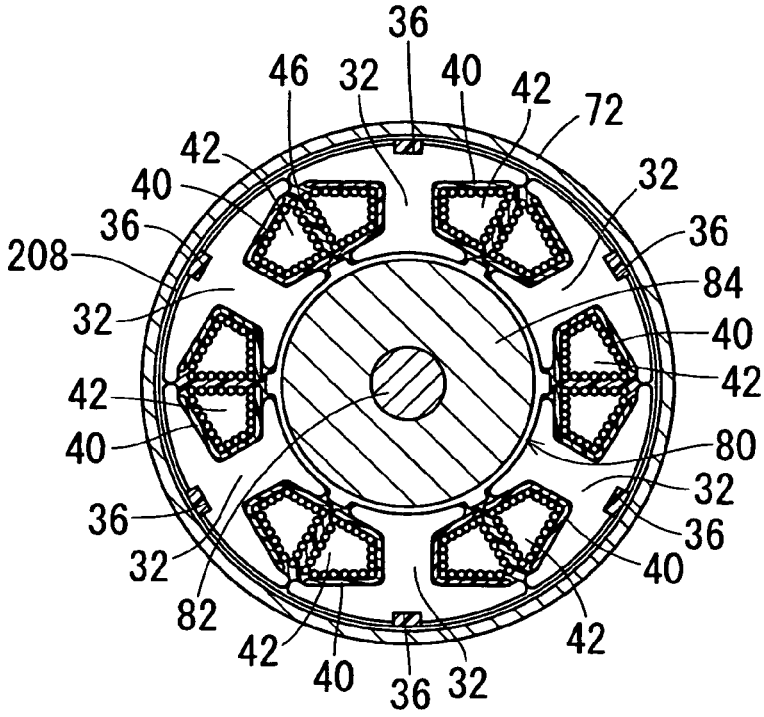
FIG. 5 is a sectional view taken along the line V-V in FIG. 4.

As shown in FIG. 5, the outer circumferential periphery of each of the teeth 32 of the stator core 30 defines a groove 36 that axially extends. The electrically insulative resin, which is formed to be the end cover 46, is charged into the groove 36.

As shown in FIG. 4, a slant restriction member 120 is in an annular shape. The slant restriction member 120 defines a through hole at the center thereof. The slant restriction member 120 makes contact with the end of the bobbin 40 on the opposite side of the pump portion 12. The slant restriction member 120 has fitting holes with which terminals 44 fit.

Figure 6:
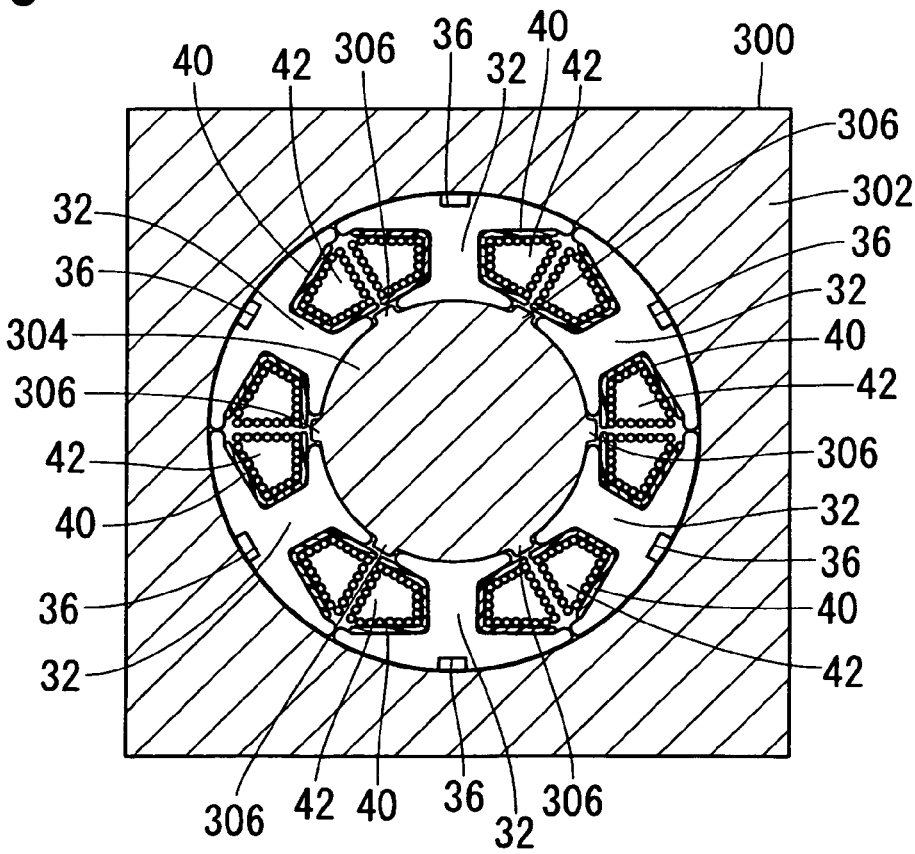
FIG. 6 is a sectional view showing a molding die accommodating components of the fuel pump.

As shown in FIG. 6, a molding die 300 is used for molding the end cover 46 of the electrically insulative resin, which is charged around the stator core 30 and the coils 42. The molding die 300 includes an outer die 302 and an inner die 304. The stator core 30 having the bobbins 40 is located between the outer die 302 and the inner die 304. Each of the coils 42 is wound around each of the bobbins 40. The side of the inner die 304 opposed to the stator core 30 has protrusions 306. The teeth 32, which are circumferentially adjacent to each other, define a clearance therebetween. Each of the protrusions 306 engages with the clearance between the teeth 32 from the radially inward circumferential periphery of the inner die 304, thereby circumferentially aligning the teeth 32. The outer circumferential end 35 (FIG. 4) of the stator core 30 on the side of the pump portion 12 makes contact with a bottom portion of the molding die 300 on the side of the outer circumferential periphery of the bobbin 40. The slant restriction member 120 makes contact with the end of the bobbin 40. The terminals 44 fit to the fitting holes of the slant restriction member 120.

Thus, the electrically insulative resin is charged from the side of the slant restriction member 120 into the molding die 300 in a condition where inserted components are located in the molding die 300, so that the end cover 46 is injection molded. The inserted components include the stator core 30, the bobbin 40, the coils 42, the terminals 44, the slant restriction member 120, and the like. In this condition, the outer circumferential end 35 of the stator core 30 on the side of the pump portion 12 makes contact with the bottom portion of the molding die 300. Therefore, the inserted components can be readily aligned with respect of the molding die 300. In addition, the stator core 30 can be restricted from being axially misaligned with respect to the molding die 300 even when the stator core 30 is applied with molding pressure axially from the slant restriction member 120.

The electrically insulative resin charged into the molding die 300 is also filled into the groove 36 defined in the outer circumferential periphery of each of the teeth 32. Thus, each of the teeth 32 is urged onto the inner die 304 by molding pressure. Consequently, the inner circumferential periphery of each of the teeth 32 on the side of the rotator 80 is circumferentially aligned along the outer circumferential periphery of the inner die 304. Therefore, the gap, which is defined between the stator core 30 and the permanent magnet 84 after molding the end cover 46, can be uniformized with respect to the rotative direction.

As described above, the inert-molding process of the stator core 30 has been described with reference to FIG. 6. The molded stator core 30 is removed from the molding die 300. Subsequently, the molded stator core 30 is assembled with the rotator 80 and the housing 72 to be in the condition shown in FIG. 5. Specifically, in FIG. 5, when the molded stator core 30 is inserted into the housing 72, the molded stator core 30 and the housing 72 therebetween define the space 208 around the outer circumferential periphery of the stator core 30.

In the molding process of FIG. 6, the electrically insulative resin material filled into each groove 36 and the electrically insulative resin material filled between the teeth 32 may cause a flash and such a flash may be detached after molding the end cover 46. Even when the flash is detached to the circumferentially outer side of the stator core 30 after or when the molded stator core 30 is inserted into the housing 72, the detached flash is retained in the space 208 (FIG. 4) defined around the outer circumferential periphery of the stator core 30. Therefore, the flash can be restricted from being stuck in a sliding member of the fuel pump 110, so that pressure of the fuel pump 110 can be maintained.

The injection molding is conducted in the condition where the terminals 44 fit to the fitting holes of the slant restriction member 120, so that the terminals 44 can be restricted from being inclined by molding pressure, thereby being restricted from causing interference with peripheral components of the terminals 44.

In the fourth embodiment, the terminals and the stator core are insert-molded of electrically insulative resin material, so that the coils can be insulated from fuel. Thus, the coil can be protected from corrosion.

In the fourth embodiment, the outer circumferential end of the one axial end of the stator core is at least partially not exposed to the electrically insulative resin. The outer circumferential end of the stator core is abutted against the axial end of the recession. Therefore, the stator core can be readily aligned axially with respect to the housing when the stator core charged with the electrically insulative resin is assembled into the housing.

In the above first to fourth embodiments, the recession defined by the inner circumferential periphery of the metallic housing accommodates the stator core 30, so that the thickness of the housing surrounding the outer circumference of the stator core 30 can be reduced, and the outer diameter of the brushless motor can be reduced. Consequently, the fuel pump downsized using the brushless motor, which is excellent in motor efficiency, can be further reduced in size. Therefore, the fuel pump can be provided in a fuel tank, even in a small fuel tank for a motorcycle, for example. Furthermore, even a fuel tank for a motorcycle has a saddle shape, the fuel pump can be provided to a limited space in the fuel tank.

In the second to fourth embodiments, the recession can be defined in the inner circumferential periphery of the housing for accommodating the stator core without denting the outer periphery of the housing. Therefore, when a treatment such as plating is applied to the outer circumferential periphery of the housing, the treatment can be readily and uniformly applied.

In the first to fourth embodiments, the housing includes a pump housing portion, an intermediate housing portion, and a motor housing portion. The pump housing portion circumferentially surrounds the outer circumferential periphery of the pump portion 12. The motor housing portion circumferentially surrounds the outer circumferential periphery of the stator core 30. The intermediate housing portion is interposed axially between the pump housing portion and the motor housing portion. The intermediate housing portion may be defined by one of the protrusion 16 in the first embodiment, the thick portion 74 in the second and fourth embodiments, and the inner circumferential housing 96 in the third embodiment. The intermediate housing portion has the inner diameter that is less than the inner diameter of the pump housing portion. The intermediate housing portion has the inner diameter that is less than the inner diameter of the motor housing portion.

Fifth Embodiment

Figure 7:
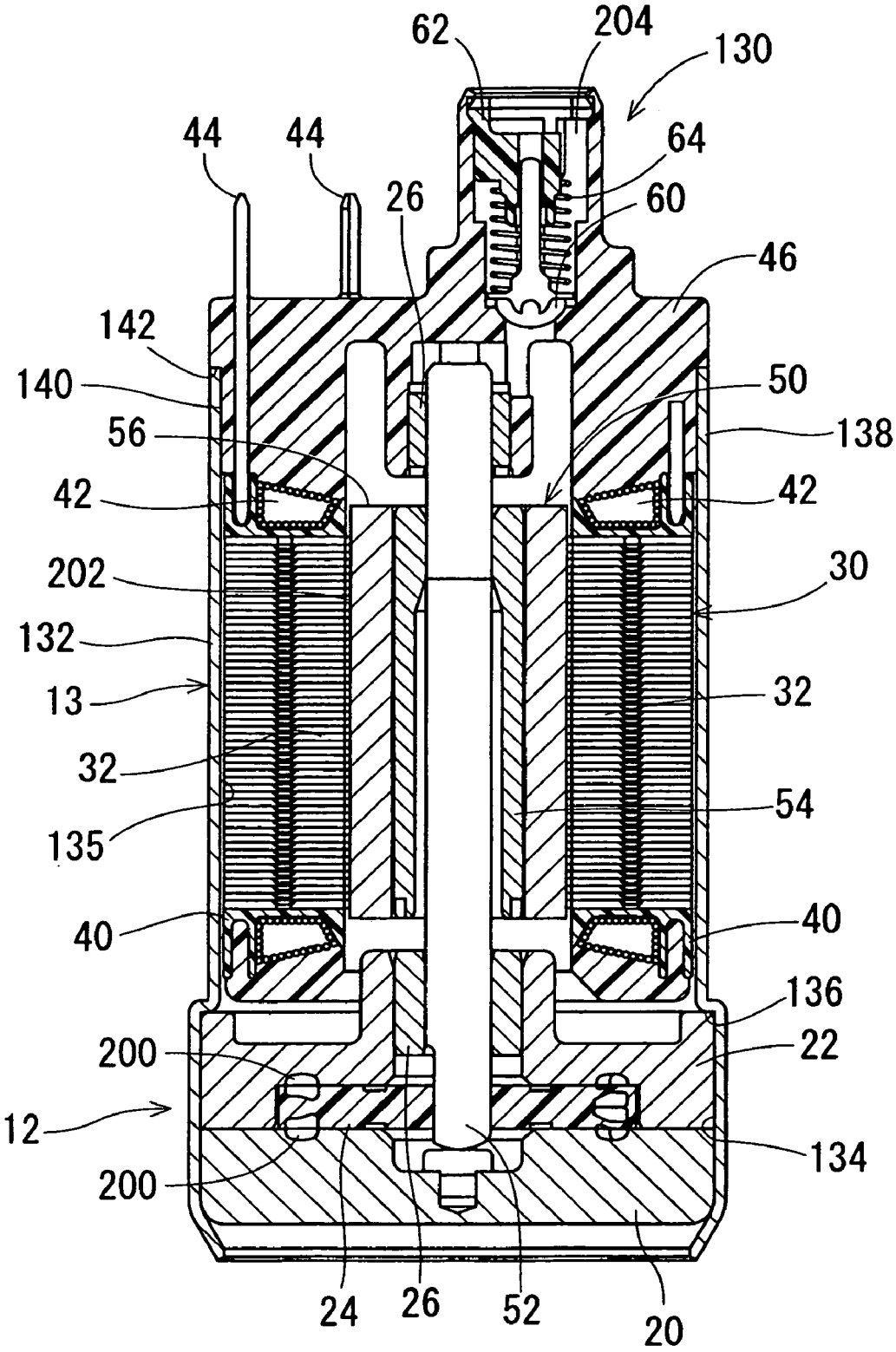
FIG. 7 is a cross sectional view showing a fuel pump according to a fifth embodiment.

As shown in FIG. 7, in a fuel pump 130 of the fifth embodiment, a housing 132 is shaped by press-forming a metallic thin plate to be in a substantially cylindrical shape. The housing 132 has an accommodating portion 134 that accommodates components of the pump portion 12. The housing 132 has an accommodating portion 135 that is radially dented inwardly with respect to the accommodating portion 134. The accommodating portion 135 accommodates components of the motor portion 13 including the stator core 30. That is, the outer diameter of the accommodating portion 135 is less than the outer diameter of the accommodating portion 134. The accommodating portion 134 and the accommodating portion 135 define a step 136 therebetween. In the step 136, the outer diameters of the accommodating portions 134, 135 are different from each other.

The housing 132 has an end 138 on the opposite side of the pump portion 12. The end 138 is press-fitted to an outer circumferential periphery 140 of the end cover 46. The end 138 is axially abutted against a step 142 defined by the outer circumferential periphery 140, so that the end cover 46, the stator core 30, and the housing 132 are axially aligned.

The pump case 22 is press-inserted into the accommodating portion 134 of the housing 132, thereby being axially abutted against the step 136 of the housing 132.

In the fifth embodiment, the accommodating portion 135, which accommodates the component of the motor portion 13, is radially dented inwardly with respect to the accommodating portion 134, which accommodates the components of the pump portion 12. Therefore, the accommodating portion 135 accommodating the stator core 30 can be readily formed without increasing the thickness of the housing 132. In addition, the outer diameter of the motor portion 13 is reduced. Thus, the outer diameter of the motor portion 13 is reduced. Therefore, the fuel pump can be provided in a fuel tank, even if the fuel tank is small (in a motorcycle, for example).

The outer circumferential periphery of the housing 132 defines only the step 136, in which the outer diameter of the housing 132 changes. Therefore, the outer circumferential periphery of the housing 132 can be readily plated uniformly for protecting the housing 132 from corrosion.

Other Embodiment

In the above embodiments, the pump portion 12 is constructed of the turbine pump including the impeller 24. Alternatively, the pump portion may be constructed of a pump having another structure such as a gear pump.

In the above embodiments, the housing 14, 72, the outer circumferential housing 94, the inner circumferential housing 96, and the housing 132 are formed of metal. Alternatively, the housings may be formed of a material other than metal such as resin.

In the fourth embodiment, the entire circumferential periphery of the outer circumferential end 35 of the axial end 34 of the stator core 30 on the side of the pump portion 12 is not exposed to the electrically insulative resin. Alternatively, the circumferential periphery of the outer circumferential end 35 may be partially exposed to the electrically insulative resin by only partially abutting the outer circumferential end 35 against the molding die, and charging electrically insulative resin.

The above structures of the embodiments can be combined as appropriate. For example, the structure of the housing 132 in the fifth embodiment can be combined with the housings 72, 94, 96, in the above second to fourth embodiments, in dependence upon design of the stator core and the pump portion. The outer diameter of the fuel pump can be effectively reduced by applying and combining the above structures.

In the above embodiments, the structures of the housings are applied to fuel pumps. However, the structures of the housings are not limited to the application of the fuel pumps. The structures of the housings can be applied to any other fluid pumps.

It should be appreciated that while the processes of the embodiments have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fluid pump comprising:

a stator core having a stator core inner circumferential periphery;

a plurality of coils that are respectively wound around the stator core, the plurality of coils circumferentially generating magnetic poles in the stator core inner circumferential periphery when being supplied with electricity, the magnetic poles being switched by controlling electricity supplied to the plurality of coils;

a rotator that is rotatable within the stator core inner circumferential periphery, the rotator having a rotator outer circumferential periphery opposed to the stator core inner circumferential periphery, the rotator outer circumferential periphery defining magnetic poles different from each other with respect to a rotative direction of the rotator;

a pump portion that has a rotor member, the rotator being adapted to rotate the rotor member for pumping fuel;

a housing that has a housing inner circumferential periphery having an integral protrusion defining a recession, which accommodates the stator core;

a plurality of terminals that electrically respectively connect with the plurality of coils, wherein the stator core, the plurality of coils, and the plurality of terminals are insert-molded with an electrically insulative resin material, the plurality of terminals are partially exposed outside of the electrically insulative resin material, and the stator core has a stator core first axial end defining a stator core outer circumferential end that is at least partially not exposed to the electrically insulative resin material, wherein the stator core first axial end is located on the stator core on a stator core first side that is proximate to the pump portion, the electrically insulative resin material defines a cover member that covers the stator core on a stator core second side that is axially opposite to the stator core first side, the cover member has a cover outer circumferential periphery that defines a fuel seal by making contact with the housing inner circumferential periphery, and wherein the stator core outer circumferential periphery, the housing inner circumferential periphery, and the cover outer circumferential periphery define a contact portion, and the contact portion and a portion of the stator core outer circumferential end abutted against a recession axial end define a space.

2. The fluid pump according to claim 1, wherein the pump portion includes a pump case that accommodates the rotor member, and the pump case is abutted axially against the integral protrusion.

3. The fluid pump according to claim 1, wherein the housing has a thick portion that radially protrudes inwardly in the housing, and the recession is defined by locating the thick portion between the stator core and the pump portion.

4. The fluid pump according to claim 3, wherein the housing is formed of metal, and the recession is defined by applying machining work to the housing inner circumferential periphery including the thick portion.

5. The fluid pump according to claim 1, wherein the stator core outer circumferential end is entirely not exposed to the electrically insulative resin material, and the stator core outer circumferential end is abutted against a recession axial end.

6. The fluid pump according to claim 1, wherein the housing is formed of metal.

7. A fluid pump as in claim 1, wherein:

said housing includes a pump housing portion, an intermediate housing portion, and a motor housing portion, wherein the pump housing portion circumferentially surrounds a pump portion outer circumferential periphery, the motor housing portion circumferentially surrounds a stator core outer circumferential periphery, the intermediate housing portion is interposed axially between the pump housing portion and the motor housing portion, wherein an intermediate housing portion inner diameter is less than a pump housing portion inner diameter, and the intermediate housing portion inner diameter is less than a motor housing portion inner diameter.

8. A fluid pump comprising:

a stator core having a stator core inner circumferential periphery;

a plurality of coils that are respectively wound around the stator core, the plurality of coils circumferentially generating magnetic poles in the stator core inner circumferential periphery when being supplied with electricity, the magnetic poles being switched by controlling electricity supplied to the plurality of coils;

a rotator that is rotatable within the stator core inner circumferential periphery, the rotator having a rotator outer circumferential periphery opposed to the stator core inner circumferential periphery, the rotator outer circumferential periphery defining magnetic poles different from each other with respect to a rotative direction of the rotator;

a pump portion that has a rotor member, the rotator being adapted to rotate the rotor member for pumping fuel;

a housing that has a housing inner circumferential periphery having an integral protrusion defining a recession, which accommodates the stator core;

a plurality of terminals that electrically respectively connect with the plurality of coils, wherein the stator core, the plurality of coils, and the plurality of terminals are insert-molded with an electrically insulative resin material, the plurality of terminals are partially exposed outside of the electrically insulative resin material, and the stator core has a stator core first axial end defining a stator core outer circumferential end that is at least partially not exposed to the electrically insulative resin material, wherein the stator core includes a plurality of teeth that are separate from each other, the plurality of teeth are circumferentially arranged, the plurality of coils are respectively wound around the plurality of teeth, each of the plurality of teeth has an outer circumferential periphery that defines a groove, which extends axially, and the electrically insulative resin material is charged into the groove.

9. The fluid pump according to claim 8, wherein the pump portion includes a pump case that accommodates the rotor member, and the pump case is abutted axially against the integral protrusion.

10. The fluid pump according to claim 8, wherein the housing has a thick portion that radially protrudes inwardly in the housing, and the recession is defined by locating the thick portion between the stator core and the pump portion.

11. The fluid pump according to claim 10, wherein the housing is formed of metal, and the recession is defined by applying machining work to the housing inner circumferential periphery including the thick portion.

12. The fluid pump according to claim 8, wherein the stator core outer circumferential end is entirely not exposed to the electrically insulative resin material, and the stator core outer circumferential end is abutted against a recession axial end.

13. The fluid pump according to claim 8, wherein the housing is formed of metal.

14. A fluid pump as in claim 8, wherein:

said housing includes a pump housing portion, an intermediate housing portion, and a motor housing portion, wherein the pump housing portion circumferentially surrounds a pump portion outer circumferential periphery, the motor housing portion circumferentially surrounds a stator core outer circumferential periphery, the intermediate housing portion is interposed axially between the pump housing portion and the motor housing portion, wherein an intermediate housing portion inner diameter is less than a pump housing portion inner diameter, and the intermediate housing portion inner diameter is less than a motor housing portion inner diameter.

15. A fluid pump comprising:

a stator core having a stator core inner circumferential periphery;

a plurality of coils that are respectively wound around the stator core, the plurality of coils circumferentially generating magnetic poles in the stator core inner circumferential periphery when being supplied with electricity, the magnetic poles being switched by controlling electricity supplied to the plurality of coils;

a rotator that is rotatable within the stator core inner circumferential periphery, the rotator having a rotator outer circumferential periphery opposed to the stator core inner circumferential periphery, the rotator outer circumferential periphery defining magnetic poles different from each other with respect to a rotative direction of the rotator;

a pump portion that has a rotor member, the rotator being adapted to rotate the rotor member for pumping fuel;

a housing that has a housing inner circumferential periphery defining a recession, which accommodates the stator core;

a plurality of terminals that electrically respectively connect with the plurality of coils, wherein the stator core, the plurality of coils, and the plurality of terminals are insert-molded with an electrically insulative resin material, the plurality of terminals are partially exposed outside of the electrically insulative resin material, and the stator core has a stator core first axial end defining a stator core outer circumferential end that is at least partially not exposed to the electrically insulative resin material;

wherein the stator core first axial end is located on the stator core on a stator core first side that is proximate to the pump portion, the electrically insulative resin material defines a cover member that covers a stator core second side that is axially opposite to the stator core first side, the cover member has a cover outer circumferential periphery that defines a fuel seal by making contact with the housing inner circumferential periphery, and wherein the stator core outer circumferential periphery, the housing inner circumferential periphery, and the cover outer circumferential periphery define a contact portion, and the contact portion and a portion of the stator core outer circumferential end abutted against a recession axial end define a space.

16. A fluid pump comprising:

a stator core having a stator core inner circumferential periphery;

a plurality of coils that are respectively wound around the stator core, the plurality of coils circumferentially generating magnetic poles in the stator core inner circumferential periphery when being supplied with electricity, the magnetic poles being switched by controlling electricity supplied to the plurality of coils;

a rotator that is rotatable within the stator core inner circumferential periphery, the rotator having a rotator outer circumferential periphery opposed to the stator core inner circumferential periphery, the rotator outer circumferential periphery defining magnetic poles different from each other with respect to a rotative direction of the rotator;

a pump portion that has a rotor member, the rotator being adapted to rotate the rotor member for pumping fuel;

a housing that has a housing inner circumferential periphery defining a recession, which accommodates the stator core;

a plurality of terminals that electrically respectively connect with the plurality of coils, wherein the stator core, the plurality of coils, and the plurality of terminals are insert-molded with an electrically insulative resin material, the plurality of terminals are partially exposed outside of the electrically insulative resin material, and the stator core has a stator core first axial end defining a stator core outer circumferential end that is at least partially not exposed to the electrically insulative resin material;

wherein the stator core includes a plurality of teeth that are separate from each other, the plurality of teeth are circumferentially arranged, the plurality of coils are respectively wound around the plurality of teeth, each of the plurality of teeth has an outer circumferential periphery that defines a groove, which extends axially, and the electrically insulative resin material is charged into the groove.

* * * * *